US005975497A

United States Patent [19]

Few et al.

[11] Patent Number: 5,975,497

[45] Date of Patent: Nov. 2, 1999

[54] MULTIPIECE TRUNNION FOR A SCISSOR TYPE JACK

[75] Inventors: Jeffrey P. Few; Bernard F. Garceau, both of Elkhart, Ind.

[73] Assignee: Norco Industries, Inc., Compton, Calif.

[21] Appl. No.: 09/003,266

[22] Filed: Jan. 6, 1998

[51] Int. Cl.[6] ..... B66F 3/00

[52] U.S. Cl. ..... 254/126

[58] Field of Search ..... 403/344, 3, 4; 254/126, 122, 124, DIG. 1; 411/383, 384, 396

[56] References Cited

U.S. PATENT DOCUMENTS

| | | | |
|---|---|---|---|
| 4,025,053 | 5/1977 | Stickle, Jr. . | |
| 4,055,329 | 10/1977 | Hammond . | |
| 4,148,461 | 4/1979 | Orth . | |
| 4,289,300 | 9/1981 | Weisser et al. . | |
| 4,366,948 | 1/1983 | Hafner . | |
| 4,493,478 | 1/1985 | Fortgens | 254/126 |
| 4,583,713 | 4/1986 | Fukura et al. . | |
| 4,585,212 | 4/1986 | Yanker . | |
| 4,659,066 | 4/1987 | VanLierop . | |
| 4,695,036 | 9/1987 | Yukimoto et al. . | |
| 4,718,519 | 1/1988 | Barker . | |
| 4,765,595 | 8/1988 | Alten . | |
| 4,802,653 | 2/1989 | Engel . | |
| 4,836,502 | 6/1989 | Yamauchi . | |
| 5,029,814 | 7/1991 | Liegel et al. . | |
| 5,118,083 | 6/1992 | Metzen . | |
| 5,303,898 | 4/1994 | Engel et al. | 254/126 |
| 5,364,071 | 11/1994 | Lu . | |
| 5,419,534 | 5/1995 | Vesley . | |
| 5,449,149 | 9/1995 | Popowich . | |
| 5,481,769 | 1/1996 | Schneider . | |
| 5,603,486 | 2/1997 | Liu . | |
| 5,692,730 | 12/1997 | Gill | 254/DIG. 1 |
| 5,697,598 | 12/1997 | Fabiano et al. | 254/126 |

*Primary Examiner*—David A. Scherbel
*Assistant Examiner*—Lee Wilson
*Attorney, Agent, or Firm*—Oldham & Oldham Co., LPA

[57] ABSTRACT

The present invention relates to a multi piece trunnion. More specifically, this invention relates to a multi piece trunnion for use in scissor-type jacks. The multi piece trunnion allows the use of a trunnion segment with an enlarged center section without a corresponding increase in the size of the channel members of the jack. The enlarged trunnion segment increases the load capacity if the scissor jack without a significant size or weight increase.

16 Claims, 3 Drawing Sheets

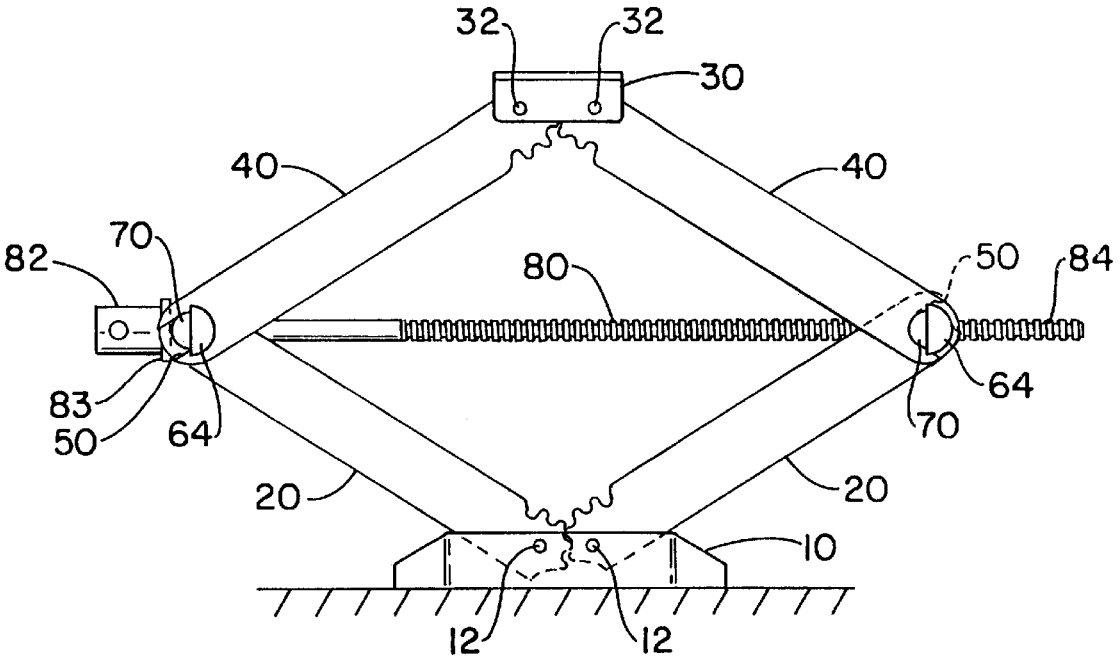
FIG.-1
FIG.-2
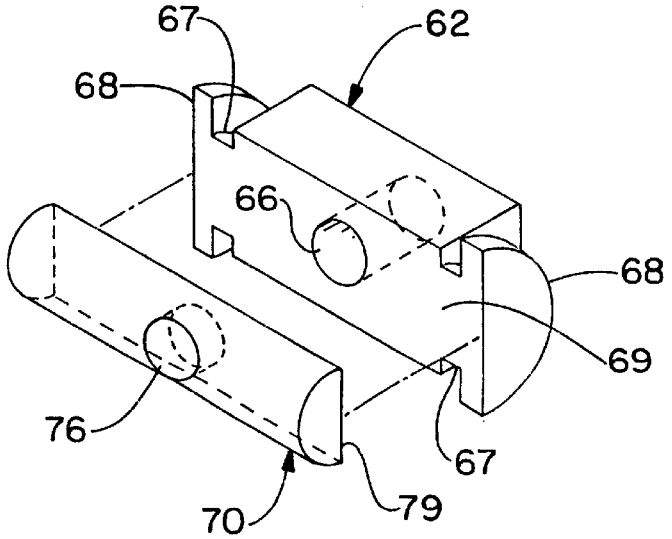

MULTIPIECE TRUNNION FOR A SCISSOR TYPE JACK

TECHNICAL FIELD

The present invention relates generally to scissor type jacks and more specifically to an improved trunnion for a scissor-type jack.

BACKGROUND OF THE INVENTION

Scissor-type jacks are used to apply force to lift many objects including motor vehicles. Many auto manufacturers include scissor type jacks as standard equipment for emergency tire changes. The compact size and ease of use make scissor-type jacks a popular choice for this type of application.

Generally, prior art scissor jacks include one pair of upper channel members and one pair of lower channel members, a base plate, a load bearing plate, pivot pins and a screw bar. The top ends of the upper channel members are pivotally mounted to a load bearing plate. The bottom ends of the lower channel members are pivotally mounted to a base plate. Each upper channel member is pivotally engaged to a lower channel member using a cylindrical pivot pin. These pins are herein referred to as trunnions. The trunnions have a centrally located through hole disposed perpendicular to their longitudinal axis.

A common scissor type jack employs one trunnion in which the through hole is threaded, and one trunnion with a plain through hole. A screw bar that is threaded on one end is placed through the plain through hole in one trunnion and is threadably engaged in the threaded trunnion. The trunnions are typically inserted through the channel members by way of circular holes formed in each of the opposed planar sides of each channel member. These holes are limited in size by the size of the channel members, as too large a hole would adversely weaken the channel members. The hole size in the channel limits the diameter of the cylindrical trunnion that can be inserted into the hole. The diameter of the cylindrical trunnion limits the diameter of the through hole centrally located in the trunnion, and also limits the length of engagement of the internal threads that are disposed in the hole of the threaded trunnion. In turn, the diameter of the through hole located in the threaded trunnion limits the diameter of the screw bar.

All of these limitations dictate the load capacity of the jack. Destructive testing has shown that a typical failure location for a scissor jack occurs at the internal threads of the threaded trunnion. Therefore, it would be desirable to increase the thread area of the threaded trunnion, thereby increasing the length of engagement between the threaded trunnion and the screw bar, which would increase the load capacity of the jack. The easiest way to accomplish this is to increase the diameter of the cylindrical trunnions, thus allowing a longer through hole and therefore more threads. This however would require an increase in the size of the channel members to accommodate the larger hole required for the larger diameter cylindrical trunnions. Such a size increases would demand more storage space be allotted in the trunk of a vehicle for the larger jack, and the corresponding increase in weight would be undesirable by making the jack more difficult to maneuver and operate.

An alternate method of increasing the length of thread engagement requires that a tube with internal threads be affixed to the cylindrical trunnion. This is disclosed in U.S. Pat. No. 5,449,149. This method makes the jack more difficult to manufacture. Using a finer thread pitch on the screw bar and in the threaded trunnion would also increase the strength of the threaded connection, but would require more revolutions of the screw bar to achieve the same vertical displacement. Therefore, it would be desirable to increase the load carrying capacity of the jack without a dramatic increase in the weight of the jack, and without making the use and manufacture of the jack more complex.

The cylindrical trunnions are secured in place by a variety of methods including spring clips, bolts, nuts and swaging the ends of the trunnion. These methods also strengthen the channel member by creating a flange surface to prevent the channel sides from spreading under a load. However, these methods all add parts and/or production steps. Therefore, it would also be desirable to have a method to secure the trunnions with a flange formed integrally to the trunnion.

In light of the deficiencies in prior art, the applicants' invention is herein submitted.

SUMMARY

The present invention discloses an improved trunnion for scissor-type jacks. A preferred embodiment includes a scissor jack with one pair of upper channel members and one pair of lower channel members, a base plate, a load support plate, a screw bar and two multi piece trunnions. The top ends of the upper channel members are pivotally mounted to the load support plate, and have meshing gear teeth to keep the channels in proper alignment. The bottom ends of the lower channel members also have meshing gear teeth for channel alignment, and are pivotally mounted to the base plate. A preferred embodiment further discloses a two-piece trunnion that is composed of a support member and a key member. Each member of each two-piece trunnion has a centrally located through hole disposed perpendicular to its longitudinal axis. The support member of one of the two piece trunnions has threads disposed within its centrally located through hole. Each support member has an oversized center section. This oversize section adds strength and lessens the deflection of both support members by increasing their thickness, and allows for an increase in the thread area inside the centrally disposed through hole of the threaded support member. An increase in thread area allows for an increase in the thread engagement length between the screw bar and the support member of the threaded trunnion. This effectively strengthens the jack, thereby increasing its load carrying capacity. A novel two-piece trunnion design accomplishes this without requiring an increase in the size of the channel members to accommodate the centrally enlarged trunnions. There are assembly slots and apertures located in the opposed planar sides of the lower ends of the upper channel members, and in the upper ends of the lower channel members. The slots are formed in a shape that will allow the support member to be easily inserted and then become locked in place within the aperture upon insertion of the cooperating key member. This is accomplished without bending, crimping or otherwise deforming the channel members or the trunnions themselves. The key members are designed so that they are locked in place against the support member by the screw bar. A preferred embodiment of the present invention also discloses a two-piece trunnion with flanges or caps at longitudinally opposed ends. The flanges support the opposed planar sides of the channel members, and keep the sides from spreading under a load.

Therefore, it is an object of the present invention to provide a two-piece trunnion for scissor-type jacks.

It is a further object of the present invention to provide a two-piece trunnion for scissor-type jacks that increases the load carrying capacity of the jack.

It is a further object of the present invention to provide a two-piece trunnion for scissor-type jacks with an increased mass and length of engagement between the screw bar and the threaded trunnion that allows for a stronger threaded connection.

It is a further object of the present invention to provide a two-piece trunnion for scissor-type jacks with an enlarged central section that strengthens the jack without a dramatic increase in size or weight.

It is a further object of the present invention to provide a two-piece trunnion for scissor-type jacks that can be easily assembled and locked in place.

BRIEF DESCRIPTION OF THE DRAWINGS

FIG. 1 is a front elevational view of a scissor-type jack using the present invention as the trunnions.

FIG. 2 is a perspective view of the key member and the support member of the two-piece trunnion of the present invention.

DETAILED DESCRIPTION OF THE PREFERRED EMBODIMENT

Figure 3:
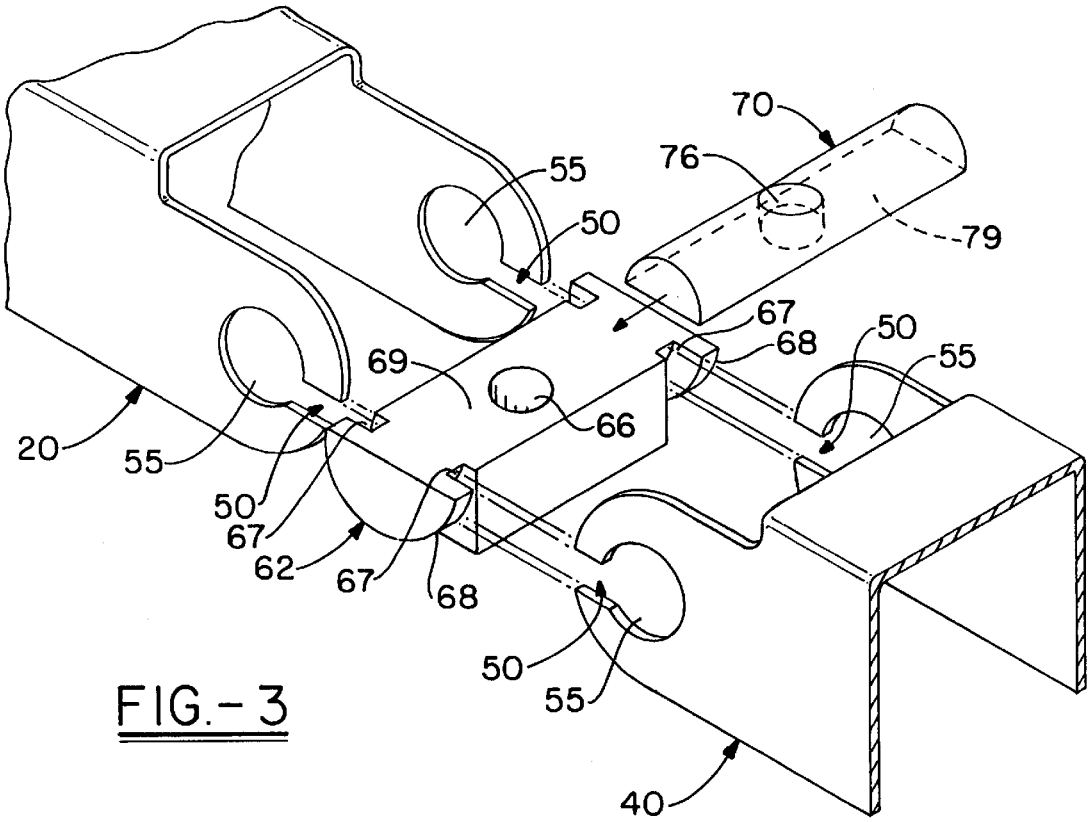
FIG. 3 is an exploded fragmentary perspective view of an upper and a lower channel member of a scissor-type jack showing the slots at the end of each channel member and the two-piece trunnion of the present invention.

This invention will be described in detail with reference to the preferred embodiment thereof. Elements are identified with reference numerals throughout the drawings and the specification.

Now with reference to the drawings, FIG. 1 illustrates a preferred embodiment of the present invention, with the two-piece trunnions in place in a scissor-type jack. The jack includes a baseplate 10, onto which the lower ends of first and second lower channel members 20 are pivotally mounted by means of pins 12. First and second upper channel members 40 are pivotally mounted at their upper ends to load support plate 30, by means of pins 32. Pins 12 and 32 can be rivets, solid pins, bolts or any other fasteners suitable for a pivotal connection. In the preferred embodiment, baseplate 10, load support plate 30 and first and second upper and lower channel members 20 and 40 are typically formed of stamped steel or plastic. The lower ends of first and second upper channel members 40 are pivotally connected to the upper ends of first and second lower channel members 20, at slots 50, by a first and a second two-piece trunnion. The first two-piece trunnion comprises a plain, non-threaded support member 62, and a first key member 70. The second two-piece trunnion comprises a threaded support member 64, and a second key member 70. Threaded support member 64 is identical to plain support member 62 in all aspects except that threaded support member 64 has threads disposed within its through-hole.

A screw bar 80, has a threaded end 84, and a joint 82 disposed on the opposite end. In a preferred embodiment the threads are a dual start Acme configuration. Joint 82 may be formed as an integral part of screw bar 80, or it may be affixed by welding, a bolt or any other means suitable for this application. Joint 82 is used as a means to rotate screw bar 80 and as a locator or stop for the non-threaded trunnion. Joint 82 may be hexagonal in shape, or formed with a hole or slot, so that a wrench or other tool may be used to rotate it. Bearing assembly 83 is disposed between joint 82 and the non-threaded trunnion, and is used as a thrust bearing surface and to reduce wear between the non-threaded trunnion and joint 82. Bearing assembly 83 may be one or more thrust bearings and/or washers. In a preferred embodiment bearing assembly 83 includes a thrust bearing between a plurality of washers. Screw bar 80 is slidably inserted in the through holes in plain support member 62 and first key member 70. Threaded portion 84, of screw bar 80, is slidably inserted in the through-hole of second key member 70, and threadably engaged in the threaded through-hole of threaded support member 64. Screw bar 80 may be swaged or other means employed to prevent its accidental removal from its installed position. The non-threaded portion of screw bar 80, adjacent to joint 82, is rotably affixed in plain support member 62 and first key member 70 of the first trunnion. Rotation of screw bar 80 drives the threaded trunnion linearly along threaded portion 84 of screw bar 80. While under a load, the non-threaded trunnion remains adjacent to joint 82, on screw bar 80. Thus, rotating screw bar 80 changes the distance between the threaded trunnion and the non-threaded trunnion, which in turn pivotally changes the angles of the channel members, effectively raising or lowering the load support plate.

Referring now to FIG. 2. This figure shows components of the non-threaded trunnion. However, it can also be used to depict the components of the threaded trunnion, with the exception of threads disposed in the through-hole of the threaded trunnion.

Plain support member 62 has a centrally located through-hole 66. The central axis of through-hole 66 is perpendicular to the longitudinal axis of plain support member 62. Flanges 68 are disposed at longitudinally opposed ends of plain support member 62, and form slots 67. First key member 70 has a centrally located through hole 76. The central axis of through hole 76 is perpendicular to the longitudinal axis of first key member 70. When installed in the channel members of the jack, side 79, of first key member 70 is adjacent to side 69 of support member 62, and through holes 76 and 66 align on a common central axis.

Referring now to FIG. 3. This exploded view shows the relationship of the non-threaded trunnion and the first upper and lower channel members, but also accurately depicts the relationship of the threaded trunnion and the second upper and lower channel members.

The lower end of one upper channel member 40 is pivotally connected to the upper end of one lower channel member 20, by means of plain support member 62 and key member 70. Slots 67 of plain support member 62 are inserted through slots 50 of upper channel member 40 and lower channel member 20. Upper channel member 40 and lower channel member 20 are aligned so that apertures 55 of both planar sides of both channel members share a common central axis. Apertures 55 have diameters larger than the width of slots 50, forming a keyhole configuration. The keyhole type shape of slots 50 and apertures 55, allows the trunnion to be easily assembled and locked in place. First key member 70 is inserted through the aligned apertures 55, in a direction parallel to the apertures central axis so that side 79 of first key member 70 is adjacent to side 69 of plain support member 62, and so that holes 66 and 76 have a common central axis. The insertion of first key member 70 locks plain support member 62 in pivotal engagement within apertures 55 of channel members 40 and 20. This locking engagement is accomplished by key member 70 limiting the movement of support member 62 to rotation. With key member 70 in place, rotational movement does not allow support member 62 to be positioned to facilitate its removal. This is because the area of support member 62, which is defined by slots 67, has a width to thickness relationship that will only permit support member 62 to pass through slots 50 while in a position that cannot be achieved with key member 70 installed.

Figure 4:
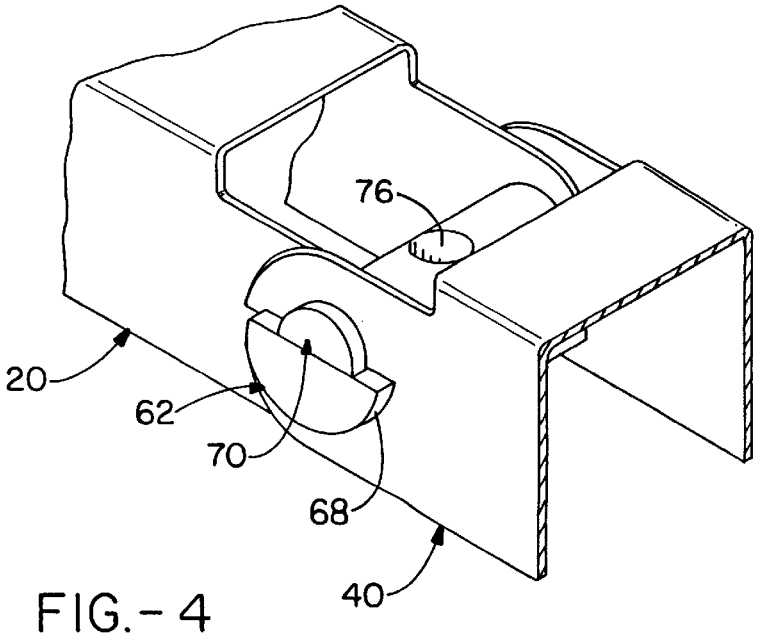
FIG. 4 is fragmentary perspective view of the parts shown in FIG. 3 in an assembled condition.

FIG. 4 shows the relationship of the parts in FIG. 3 in an assembled condition. Key member 70 locks support member 62 in pivotal engagement with the channel members 40 and 20. Key member 70 is able to be locked in place by the insertion of the screw bar through hole 76. FIG. 4 also shows flanges 68 that are disposed on longitudinally opposed ends of support members 62 and 64. Flanges 68 act as supports for the planar sides of channel members 20, and 40 and keep the sides from spreading and outwardly deforming when the jack is loaded.

Figure 5:
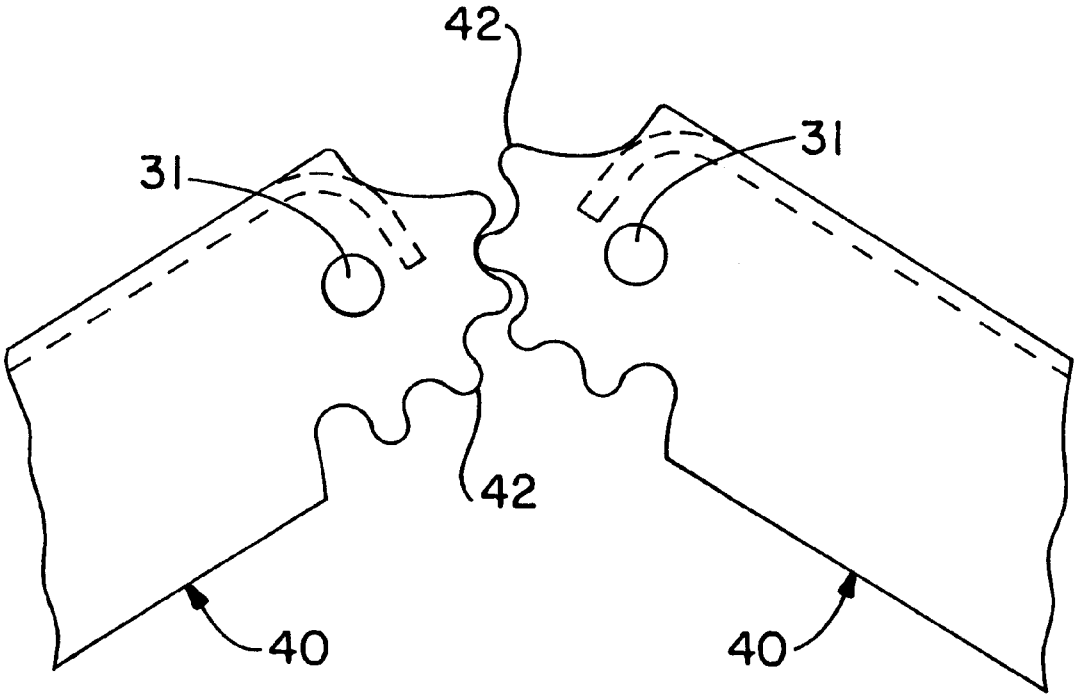
FIG. 5 is a fragmentary perspective view of the upper ends of the upper channel members, showing the relationship of the gears formed on the end of each channel member. Also shown are the holes through which the load support member is pivotally attached. The lower ends of the lower channel members are a mirror image thereof.

FIG. 5 shows the upper ends of the upper channel members 40, showing the meshing relationship of gears 42 that are formed on the end of each channel member 40. Also shown are the holes 31, through which the load support member is pivotally attached using pins 32. The lower ends of the lower channel members are a mirror image thereof.

The multi piece trunnion of the present invention could be used in many screw driven lifting and support devices other than the type specified in the preferred embodiment. Also, a multi piece threaded trunnion could be used in conjunction with a standard configuration non-threaded trunnion, and still afford an increase in strength.

The preferred embodiment of the present invention has been described. It is to be understood that the invention is not limited thereto.

What is claimed is:

1. A scissor jack comprising:

a base plate;

a load support plate;

a pair of upper channel members each having a pair of opposed planar sides and an upper and a lower end;

a pair of lower channel members each having a pair of opposed planar sides and an upper and a lower end;

said upper end of each said upper channel member being pivotally attached to said load support plate;

said lower end of each said lower channel member being pivotally attached to said base plate;

a first and a second trunnion, each trunnion pivotally connecting said lower end of an upper channel member to an upper end a lower channel member;

a drive screw mounted between said first and said second trunnions to rotate about a longitudinal axis;

at least one of said trunnions being a multipiece trunnion having a support member with an oversized center section and a cooperating key member.

2. A scissor jack as specified in claim 1, wherein the lower end of each upper channel member and the upper end of each lower channel member contains a trunnion engaging slot forming a keyhole configuration.

3. A scissor jack as specified in claim 2, wherein said keyhole configuration of said slot is composed of an open entry way and an enlarged seating region, interior of said entry way.

4. A scissor jack as specified in claim 1, wherein said support member and said key member each having a hole disposed therethrough, the central axis of said hole being perpendicular to said member's longitudinal axis.

5. A scissor jack as specified in claim 4, wherein at least one of said members is threaded inside said hole.

6. A scissor jack as specified in claim 4, wherein at least one of said members is non-threaded.

7. A scissor jack as specified in claim 1, wherein said first and second trunnions are multi piece trunnions each having a support member with an oversized center section and a cooperating key member, each said support member and said key member each having a hole disposed therethrough, the central axis of said hole being perpendicular to said member's longitudinal axis, said first trunnion having a non-threaded support member and said second trunnion having a threaded support member with threads disposed within said hole.

8. A scissor jack as stated in claim 7, wherein said drive screw has a first and a second end and is at least partially threaded from said first end; said drive screw has an outside diameter less than the inside diameter of said first non-threaded trunnion and threadably engages said support member of said second threaded trunnion.

9. A scissor jack as specified in claim 1, wherein said support member of said at least one multi piece trunnion has a flange disposed on each longitudinally opposed end to define a trunnion cap.

10. An improved scissor jack of the type having a base plate, a pair of lower channel members with planar sides each having an upper and a lower end, said lower channel members each formed with gear teeth at their lower ends, said lower channel members each having their lower ends pivotally attached to said base plate with the respective gear teeth in meshing engagement; a load support plate, a pair of upper channel members with planar sides each having an upper and a lower end; said upper channel members each formed with gear teeth at their upper ends, said upper channel members each having their upper ends pivotally attached to said load support plate with the respective gear teeth in meshing engagement; a first and a second trunnion, each having a hole disposed therethrough, perpendicular to its longitudinal axis, said trunnions formed as pivot pins for pivotally connecting said lower end of said upper channel members to said upper end of said lower channel members; a screw bar rotably engaging said first trunnion and threadably engaging said second trunnion, wherein the improvement comprises:

a first trunnion having a plurality of segments including a support member and a key member, said support member being substantially enlarged at its mid section, adjacent to said hole, so as to increase its strength;

a second trunnion having a plurality of segments including a support member with threads disposed within said hole, and a key member, said support member being substantially enlarged at its mid section, adjacent to said hole, so as to increase its strength and the length of the threads disposed within;

said upper end of said lower channel members, and said lower end of said upper channel members, each having a slot disposed on their planar sides, wherein said slot is composed of an open entry way and an enlarged seating region, interior of said slot;

said slots allow said support members, having substantially enlarged mid sections, to be inserted into said channel members, while allowing said seating region to remain small so as not to compromise the strength of said channel members;

said key members lock said support members in pivotal engagement with said channel members;

said screw bar locks said key members in pivotal engagement with said channel members;

said support members having a flange disposed at each longitudinally opposed end for preventing the planar sides of said channel members from outwardly spreading.

11. In the environment of a scissor type jack, a multi piece trunnion comprising:

a support member having a centrally located hole disposed therethrough, wherein the central axis of said hole is perpendicular to the longitudinal axis of said support member, said support member being dimensionally augmented in the area circumscribing said hole;

a key member having a hole disposed therethrough, wherein the central axis of said hole is perpendicular to the longitudinal axis of said key member, said key member being disposed adjacent to said support member, said support member being locked in pivotal engagement by said key member.

12. A multi piece trunnion as recited in claim 11, wherein said hole in said support member is threaded in said hole.

13. A multi piece trunnion as recited in claim 11, wherein said support member has a threaded extension disposed thereon.

14. A multi piece trunnion as recited in claim 11, wherein said key member has a threaded extension disposed thereon.

15. A multi piece trunnion as recited in claim 11, wherein said support member has flanges disposed at its longitudinally opposed ends.

16. A multi piece trunnion as recited in claim 11, wherein said key member has flanges disposed at its longitudinally opposed ends.

* * * * *